US005927292A

United States Patent [19]

Chicoine

[11] Patent Number: 5,927,292

[45] Date of Patent: Jul. 27, 1999

[54] SHORTCUT METHOD TO A MULTITUDE OF HAIRCUTS

[76] Inventor: Annette M. R. Chicoine, 8343 Princeton Sq. Blvd. E. #1511, Jacksonville, Fla. 32256

[21] Appl. No.: 08/903,616

[22] Filed: Jul. 31, 1997

[51] Int. Cl.[6] ..... A45D 24/00

[52] U.S. Cl. ..... 132/200

[58] Field of Search ..... 132/200, 212, 132/213, 213.1, 214

[56] References Cited

U.S. PATENT DOCUMENTS

| | | | |
|---|---|---|---|
| 2,581,704 | 1/1952 | Reno | 132/200 |
| 2,781,048 | 2/1957 | Donne | 132/214 |
| 2,789,566 | 4/1957 | Garoutte | 132/210 |
| 2,919,702 | 1/1960 | Olivo | 132/200 |
| 3,015,336 | 1/1962 | Caples | 132/213 |
| 3,223,092 | 12/1965 | Marsico | 132/200 |
| 3,536,080 | 10/1970 | Player . | |
| 3,935,870 | 2/1976 | Wall . | |
| 3,993,083 | 11/1976 | Torres | 132/213 |
| 4,137,925 | 2/1979 | Castillo . | |
| 4,230,134 | 10/1980 | Perez . | |
| 4,381,015 | 4/1983 | Harvath . | |
| 4,414,991 | 11/1983 | Marcotte . | |
| 4,520,565 | 6/1985 | Maggiore | 30/201 |
| 4,619,044 | 10/1986 | Dennis | 30/133 |
| 4,830,031 | 5/1989 | Quinones | 132/214 |
| 4,867,184 | 9/1989 | Davis | 132/214 |
| 4,926,891 | 5/1990 | Fani et al. | 132/214 |
| 5,153,994 | 10/1992 | Emmett | 30/133 |
| 5,494,057 | 2/1996 | Gianfrancesco | 132/214 |

*Primary Examiner*—Todd E. Manahan

[57] ABSTRACT

A method of cutting one's own hair in a multitude of styles and lengths comprises placing one's head in an upside-down position and combing or brushing the hair in a downward fashion and thereafter shaking the head so as to let the hair settle. The hair is then gathered at the scalp and a first elastic band is wrapped about the hair adjacent the scalp so as to leave a length of hair extending beyond the first band. The head is then placed in an upright position and a second elastic band is wrapped about the length of hair directly adjacent the first band. The second band is then slid along the length of hair away from the first band until the desired length is reached. The ends of the hair extending beyond the second band are then cut along the outer edge of the second band. To produce a softer cut, the first band may be slid along the length of hair toward the second band prior to cutting the ends of the hair.

14 Claims, 18 Drawing Sheets

SHORTCUT METHOD TO A MULTITUDE OF HAIRCUTS

BACKGROUND

1. Field of Invention

This invention relates to a new innovative, all around, versatile method of haircutting, and more specifically, a method which allows an unskilled individual to cut one's own hair precisely and uniformly. Particularly, though not exclusively for females.

2. Description of Prior Art

Hairstylists, or the like, have been a prevailant option for the general public in order to get stylish professional looking haircuts. Although hairstylists have created many new haircuts and styles, an individual has no guarantees or reassurances that one will receive a haircut one asks for, or the same haircut and style each time. Nor are there any guarantees the haircuts will be precise and uniform, as hairstylists perform by memory and experience. Thus this option does not give an individual much control in resulting haircuts.

Also, the process of going to a hairstylist can be expensive, time consuming, tedious, and inconvenient. Millions of dollars are spent by the general public for haircuts, and the cost to an individual can reach well into the thousands during the course of a lifetime. Today's society is style, cost, and time conscious, and with the expense and time spent on having haircuts done by a professional, many individuals search for alternative options, thus, there is a need.

Although various alternative options through devices and methods have been developed in the past, most are complicated, bothersome, or cumbersome, and very limited in the scope of options, such as, lengths, haircuts, styles, uniformity, and precision, and most are risky or highly susceptible to error.

Objects and Advantages

Accordingly, besides the objects and advantages of being able to cut one's own hair, I believe I have developed a new method which advantageously overcomes many of the aforementioned problems at a minimum of error, risk, effort, time, and expense, that requires no assistance or bothersome devices, and allows an unskilled individual to perform and achieve precise, uniform, professional looking results, simply, and easily.

Further objects and advantages of the present invention are:

(a) to provide an option of saving hundreds, even thousands of dollars, by lessening the need to go to a hairstylist to get professional looking haircuts.

(b) to provide an option of having complete, total control of resulting haircuts, whereby giving one more independence and freedom of choice.

(c) to provide an option of stylish haircuts quickly, easily, conveniently, inexpensively, and efficiently.

(d) to provide an option of a simple, safe method of haircutting, so simple and safe, a child of reasonable age, supervised, could cut their own hair.

(e) to provide an option of a haircutting method which can also be used on another, as well as one's own self, just as easily.

(f) to provide an option of an ecologically safe, non polluting, economical, reliable, quality method of haircutting.

(g) to provide an option of a haircutting method which is easily maintainable, and, or repeatable for a lifetime, whereby making an individuals life easier.

(h) to provide an option of a haircutting method which requires no added service requirements or continuous fees.

(i) to provide an option of a different, all around, versatile, useful, worthwhile, fun, and exciting method of haircutting that does not require any training or engenuity, whereby stimulating and encouraging creativeness.

(j) to provide an option of haircuts and styles that can be used with all hairtypes, such as straight, curly, thick, or thin.

(k) to provide an option of a haircutting method that adapts to each individual's frame of head and face, whereby complimenting and contouring to each individual that uses it.

(l) to provide an option of a multitude of all around, versatile haircuts containing, layers, bangs, sidekicks, ends (or all one length), and even combinations of these.

(m) to provide an option of haircutting that leads to self accomplishment, whereby boosting one's self esteem, and giving one a feeling of fulfillment and pride.

(n) to provide an option of a haircutting method which contains a multitude of lengths, haircuts, and styles that can range from a soft to a stacky result and look.

(o) to provide an option of a haircutting method that requires no special judgements to make, lengths and styles can be changed quickly, easily, and simply.

(p) to provide an option of a haircutting method which contains simple, common household materials such as, a mirror, most any haircutting instrument, hairbands, and, or, the use of one's own thumb and index finger, or index and forefinger.

(q) to provide an option of a worry free, highly maneuverable haircutting method that can be used and manipulated easily and efficiently for precision haircuts, that is reliable and constant.

(r) to provide an option of a haircutting method that leaves no irregularities or clusters, whereby lessening the fears of home and self haircutting.

(s) to provide an option of a haircutting method that requires no manual dexterity or special tools, whereby lessening the burden of a user.

(t) to provide an option of lessening the time consumed for haircuts or trips to a hairstylist.

(u) to provide an option that lessens the fear of contracting aids, or diseases, that may be possible when a cutting instrument is used on an individual by another, if nicks, cuts, or bleeding occurs, whereby putting one at greater ease.

Still further objects and advantages will become apparent from a consideration of the ensueing description and drawings.

DRAWING FIGURES

In the drawings, closely related figures have the same number but different alphabetic suffixes.

FIGS. 1*a* to 1*h* illustrates front and side views of various aspects of preferred embodiments.

FIGS. 2*a* to 2*d* illustrates a side view of various aspects of an individual in perspective positions pertaining to invention.

FIGS. 3*a* to 3*d* are front and a side views of individual illustrating preferred embodiments of invention.

FIGS. 4*a* and 4*b* illustrates a front and side view of perspective positions of preferred embodiments.

FIGS. 5*a* and 5*b* illustrates a front and side view of more perspective positions of preferred embodiments.

FIGS. 6*a* to 6*d* are a front and side views individual illustrating a second preferred embodiment of invention.

Figure 1A:
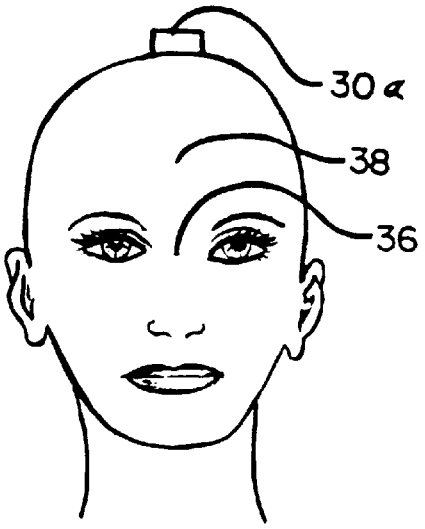

FIGS. 9*a* to 9*e* illustrates front and side views of perspective positions of a third preferred embodiment.

FIGS. 10*a* to 10*e* illustrates front and side views of perspective positions of a fourth preferred embodiment.

FIGS. 11*a* to 11*d* illustrates back and front views of indidual in perspective positions of a fifth preferred embodiment.

REFERENCE NUMERALS IN DRAWINGS

| | | | |
|---|---|---|---|
| 20 | hair | 22 | ends |
| 24 | band #1 | 26 | length of hair |
| 28 | band #2 | 30 | preferred areas |
| 32 | crown of head | 34 | cutting lines |
| 36 | bridge of nose | 38 | forehead |
| 40 | bangs | 42 | sidekicks |
| 44 | parting line | 46 | multitude of bands |

SUMMARY

In accordance with the present invention a new innovative, all around, versatile method of haircutting which can be used to cut one's own hair, or others, simply and easily, with a multitude of options, such as, haircuts, styles, and lengths. A method which requires no devices, and allows an unskilled individual to cut hair precisely, uniformly, efficiently, conveniently, and inexpensively, with professional looking results.

DESCRIPTION

FIGS. 1 to 11

Figure 1B:
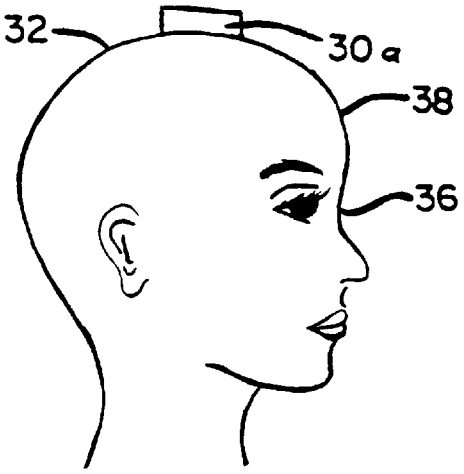
Figure 2A:
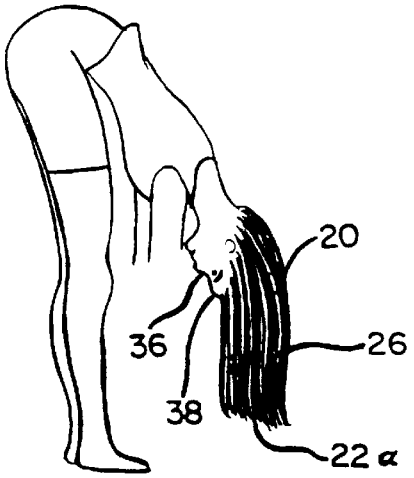
Figure 2B:
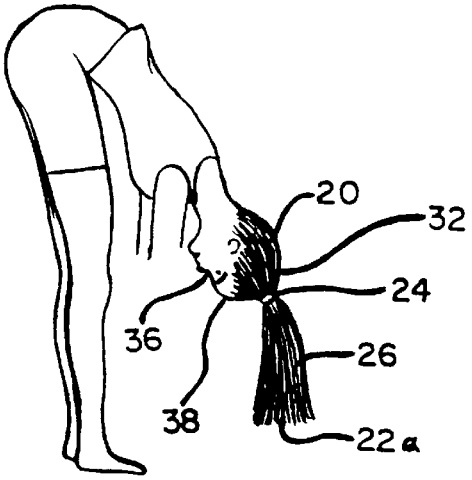
Figure 3A:
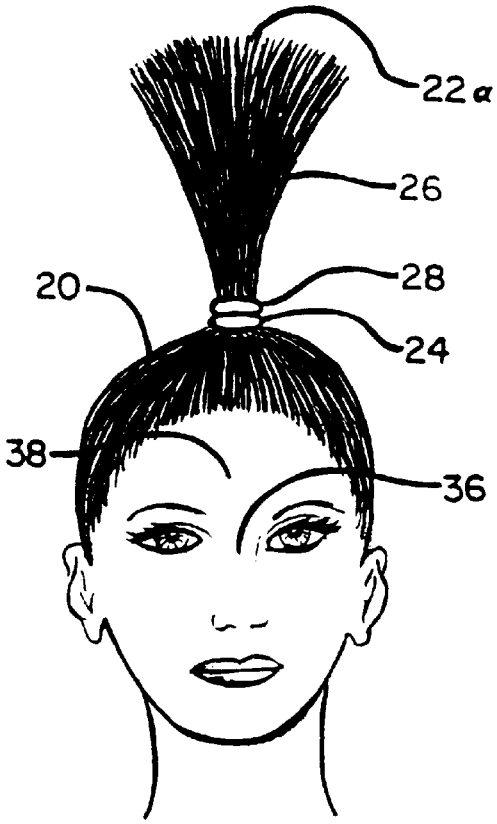
Figure 3B:
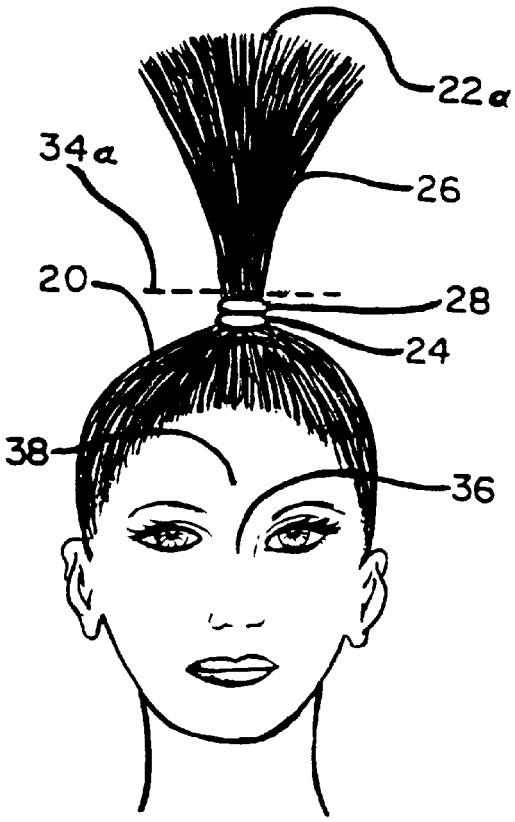
Figure 3C:
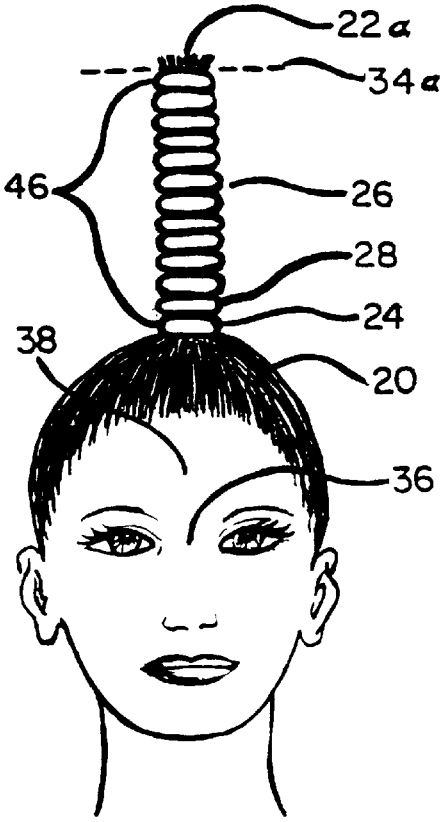
Figure 3D:
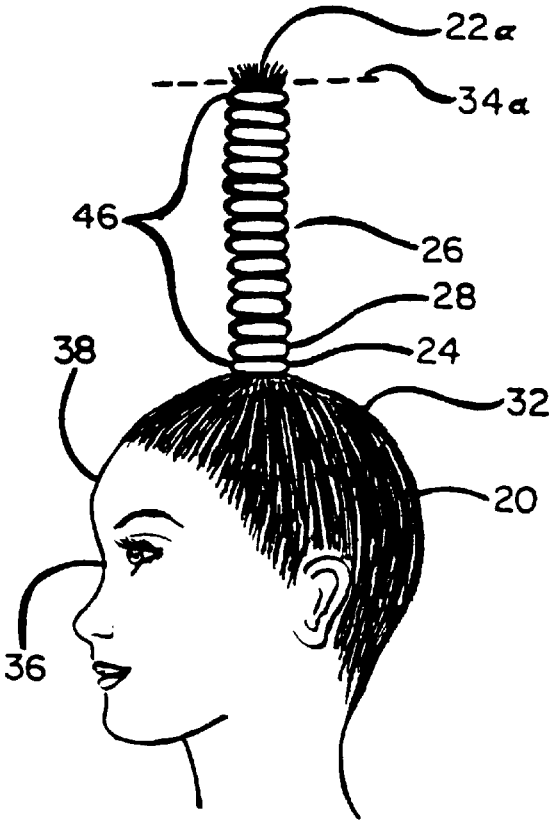
Figure 4A:
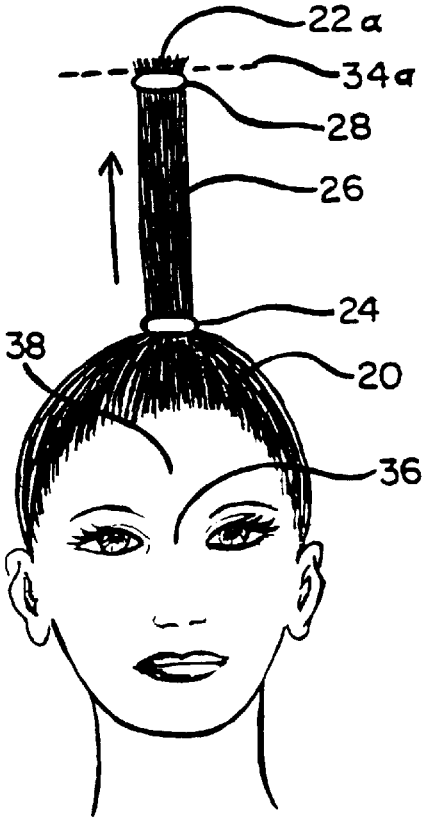
Figure 4B:
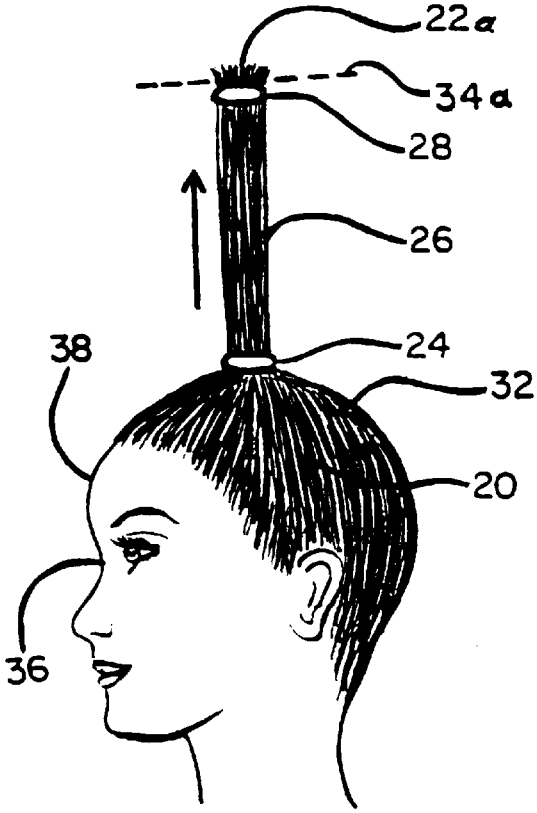
Figure 5A:
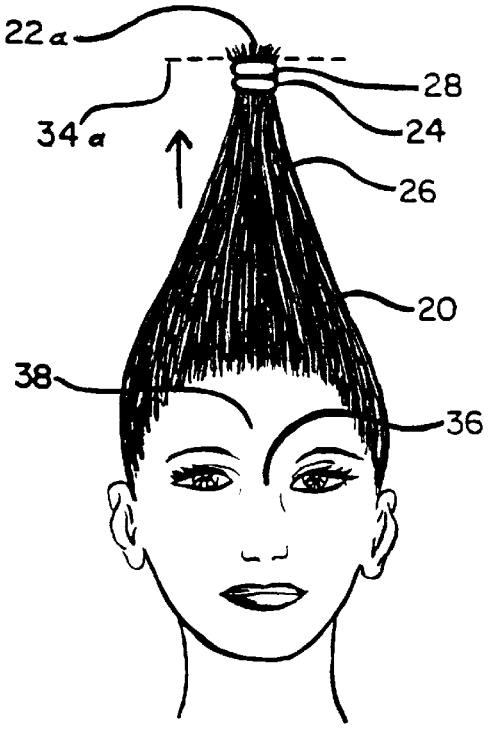
Figure 5B:
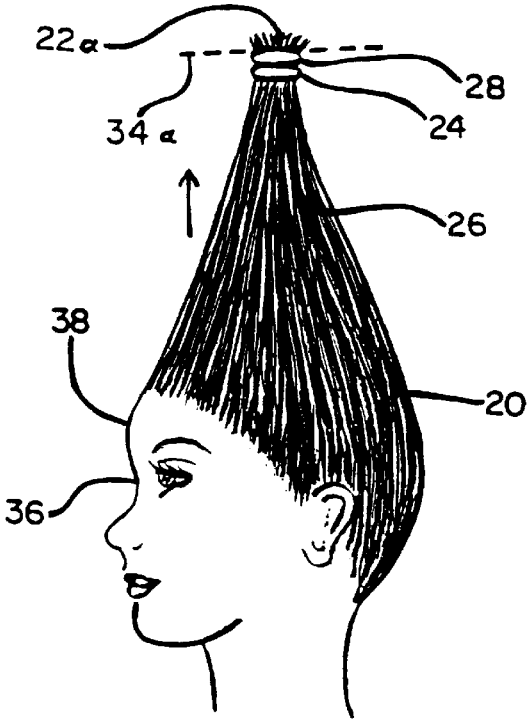

FIGS. 1*a* and 1*b* illustrates a front and side view of a hairless head showing a preferred area 30*a,* located on top of head, midway between crown of head 32, and edge of forehead 38, aligned with bridge of nose 36, boxed in. FIG. 2*a* illustrates a side view of an individual standing, bent over at waist, with head positioned upside down, so that hair 20 is flowing downward uniformly to ends 22*a*. FIG. 2*b* illustrates a same view as FIG. 2*a* with a preferred small sized "teri cloth, endless, elastic, hairband" added, band #1 24, wrapped around hair 20 at scalp, in direct alignment with bridge of nose 36, with a length of hair 26 protruding. FIGS. 3*a* and 3*b* illustrates a front view of individual's head in an upright standing position, with another preferred small sized "teri cloth, endless, elastic, hairband" added, band #2 28, directly up next to band #1 24. FIG. 3*b* shows a horizontal cutting line 34*a* added shown in broken lines directly on the outer side of band #2 28, that is even, and level to band #2 28. FIGS. 3*c* and 3*d* illustrate a front and side view of head with a multitude of bands 46 added. Length of hair 26 is up, straight, in direct alignment with bridge of nose 36, and preferred area 30*a*. A horizontal cutting line 34*a* is shown in broken lines, directly on the outer side of the last band added of the multitude of bands 46, that is even, and level to the last band added of the multitude of bands 46. FIGS. 4*a* and 4*b* illustrate a front and side view of head with band #1 24 positioned at scalp, and band #2 28 positioned just before ends 22*a*. Length of hair 26 is up, straight, in direct alignment with bridge of nose 36, and preferred area 30*a,* inbetween. A horizontal cutting line 34*a* is shown in broken lines, directly on the outer side of band #2 28, that is even, and level to band #2 28. FIGS. 5*a* and 5*b* illustrate a front and side view of head with both band #1 24, and band #2 28, positioned directly up next to each other, just before ends 22*a*. Length of hair 26 is up, straight, in direct alignment with bridge of nose 36, and preferred area 30*a*. A horizontal cutting line 34*a* is shown in broken lines, directly on the outer side of band #2 28, that is even, and level to band #2 28.

Figure 1C:
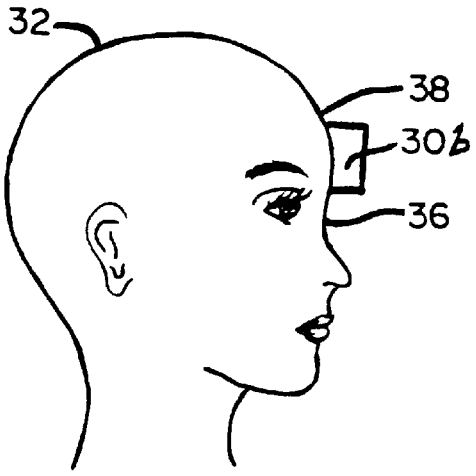
Figure 1D:
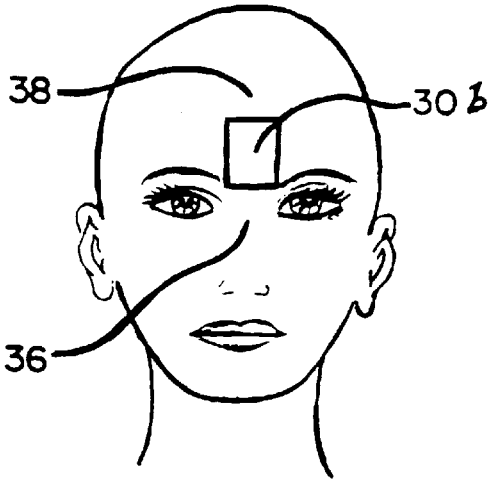
Figure 2C:
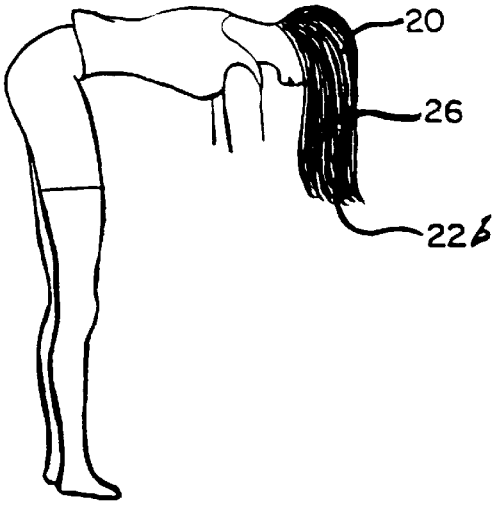
Figure 2D:
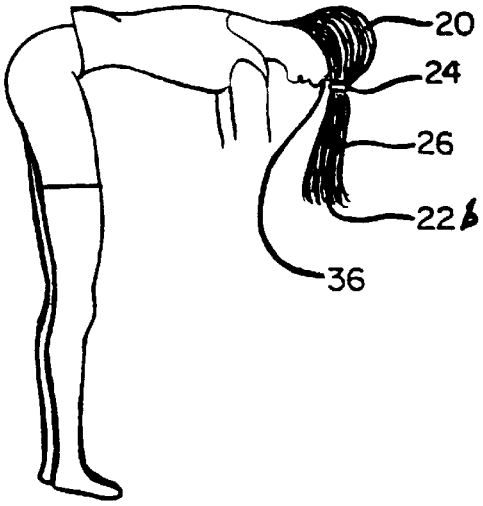
Figure 6A:
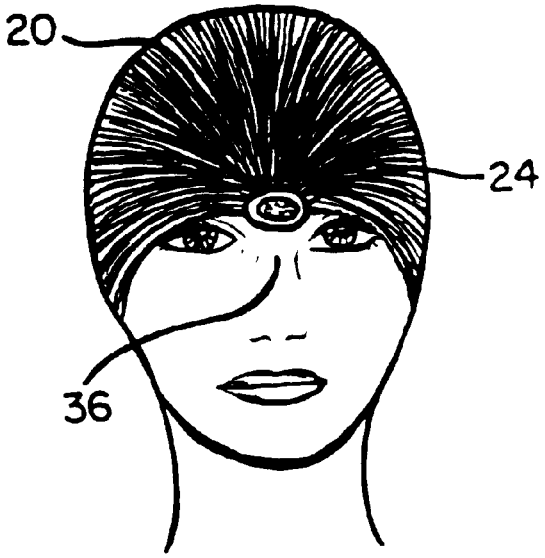
Figure 6B:
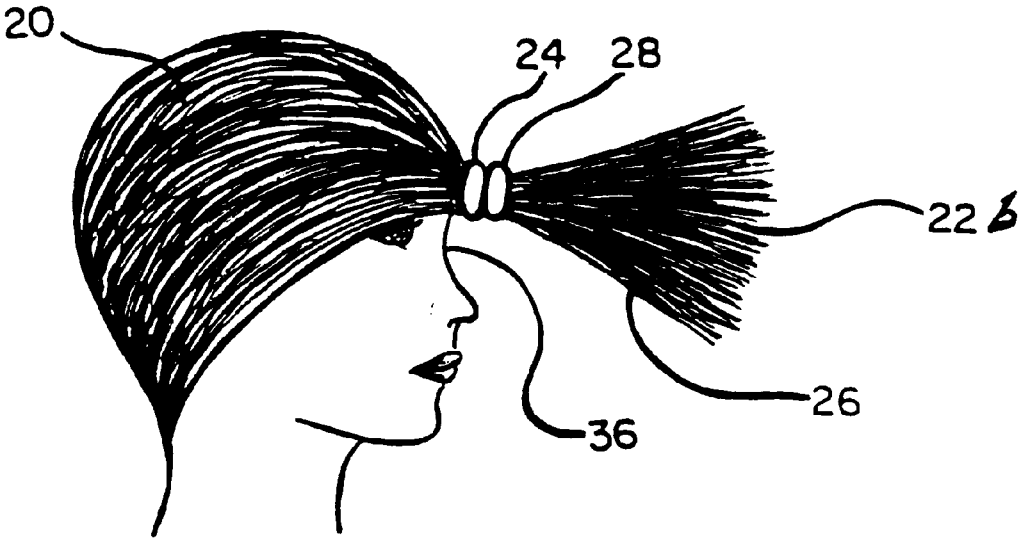
Figure 6C:
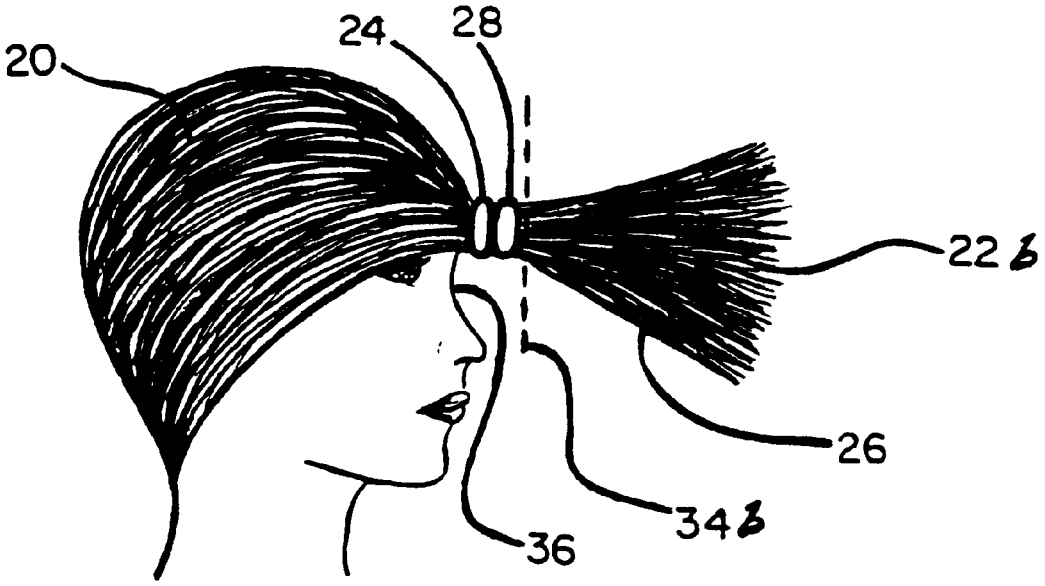
Figure 6D:
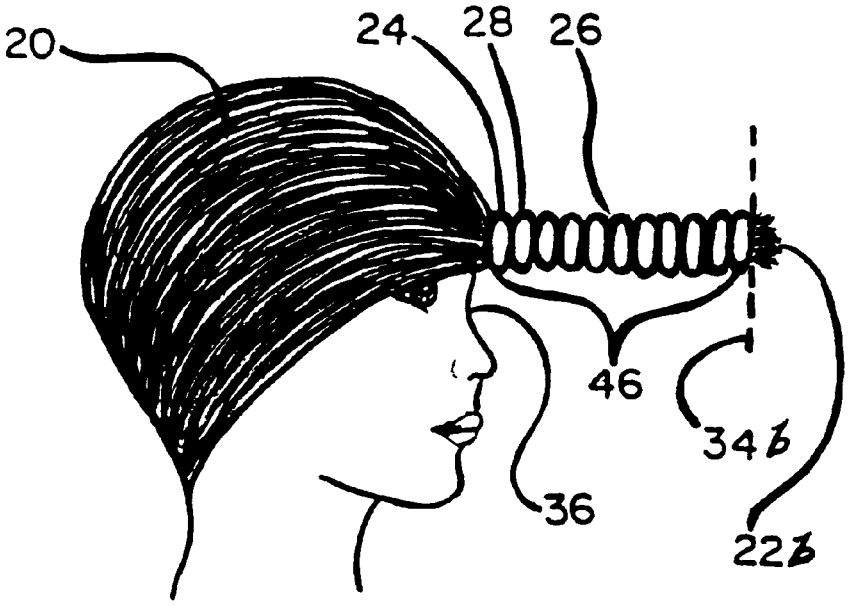
Figure 7:
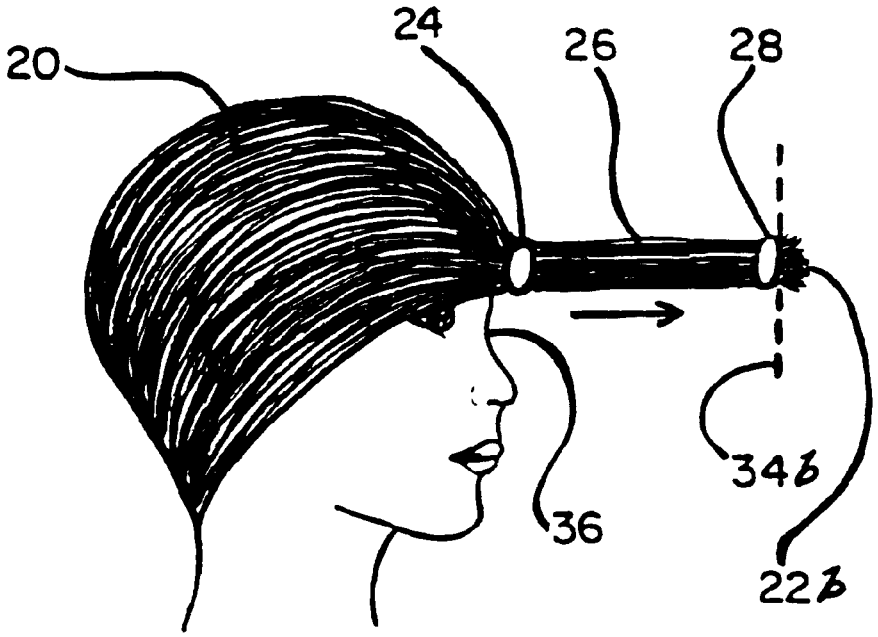
FIG. 7 illustrates a side view of perspective positions of second preferred embodiments.
Figure 8:
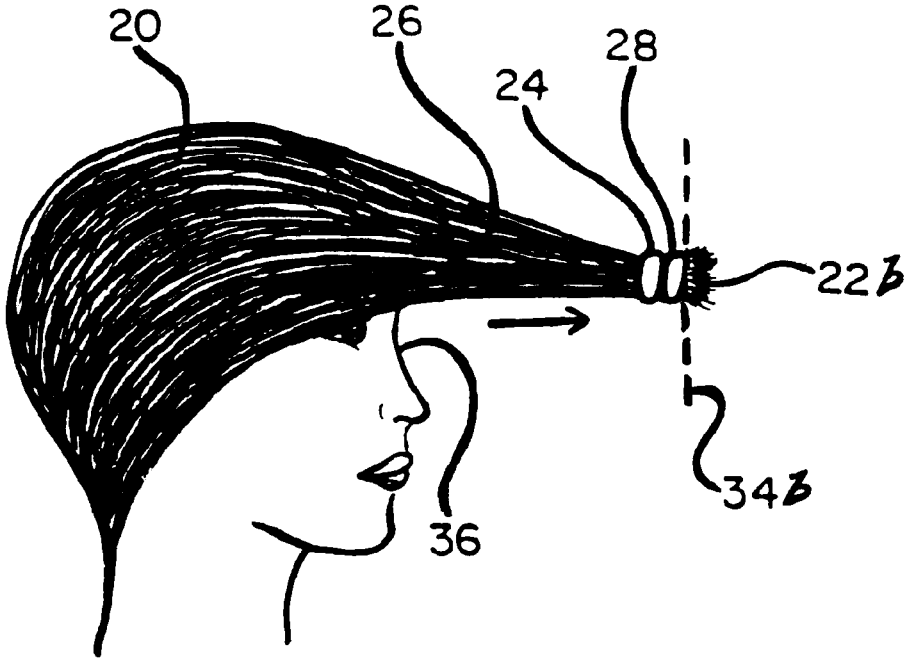
FIG. 8 illustrates a side view of more perspective positions of second preferred embodiments.

FIGS. 1*c* and 1*d* illustrate a side and front view of preferred area 30*b,* located on forehead 38, aligned with bridge of nose 36, boxed in. FIG. 2*c* illustrates a side view of individual standing, bent midway at waist, with front of head facing the ground, and hair 20 flowing downward uniformly to ends 22*b*. FIG. 2*d* illustrates a same view as FIG. 2*c* with band #1 24 added, wrapped around hair 20 at forehead 38, in direct alignment with bridge of nose 36, positioned within preferred area 30*b,* with length of hair 26 protruding. FIG. 6*a* illustrates a front view of head in upright standing position, with band #1 24 at forehead 38, in direct alignment with bridge of nose 36 (length of hair 26 is not shown to further illustrate preferred area 30*b* unobstructed). FIGS. 6*b* and 6*c* illustrates a side view of head with band #2 28 added, directly up next to band #1 24, positioned at forehead 38, aligned with bridge of nose 36. FIG. 6*c* shows a vertical cutting line 34*b* added shown in broken lines directly on the outer side of band #2 28, that is even, and level to band #2 28. FIG. 6*d* illustrates a side view of head with a multitude of bands 46 added. Length of hair 26 is out, straight, in direct alignment with bridge of nose 36, and preferred area 30*b*. A vertically cutting line 34*b* is shown in broken lines, directly on the outer side of the last band added of the multitude of bands 46, that is even, and level to the last band added of the multitude of bands 46. FIG. 7 illustrates a side view of head with band #1 24 positioned at forehead 38, aligned with bridge of nose 36, and band #2 28 positioned just before ends 22*b*. Length of hair 26 is out, straight, in direct alignment with bridge of nose 36, and preferred area 30*b,* inbetween. A vertical cutting line 34*b* is shown in broken lines, directly on the outer side of band #2 28, that is even, and level to band #2 28. FIG. 8 illustrates a side view of head with both band #1 24, and band #2 28, positioned directly up next to each other, just before ends 22*b*. Length of hair 26 is out, straight, in direct alignment with bridge of nose 36, and preferred area 30*b*. A vertical cutting line 34*b* is shown in broken lines, directly on the outer side of band #2 28, that is even, and level to band #2 28.

Figure 1E:
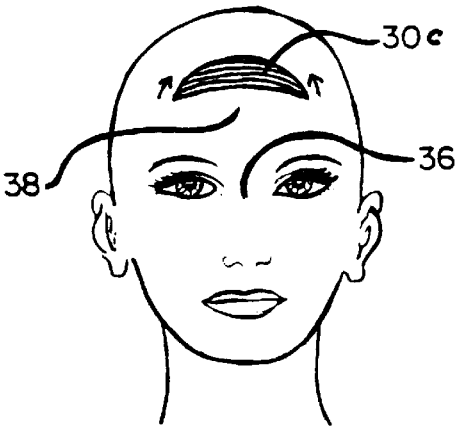
Figure 9A:
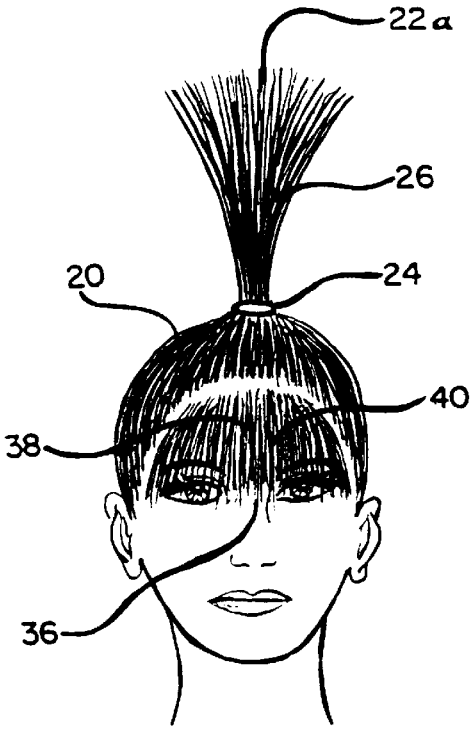
Figure 9B:
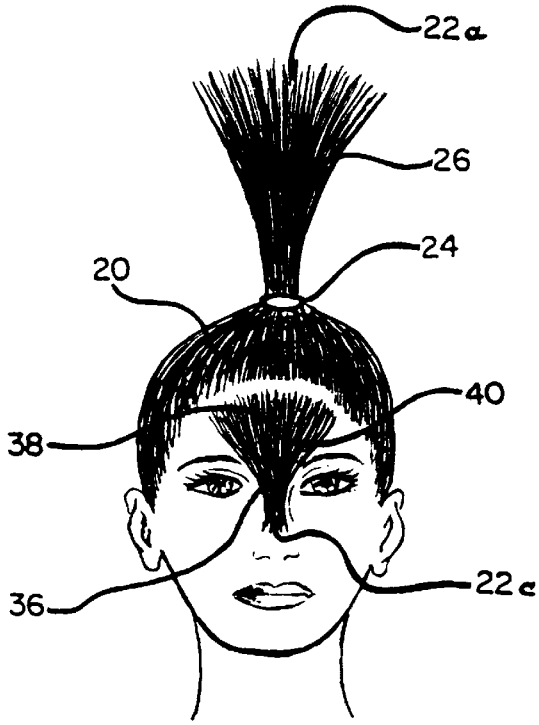
Figure 9C:
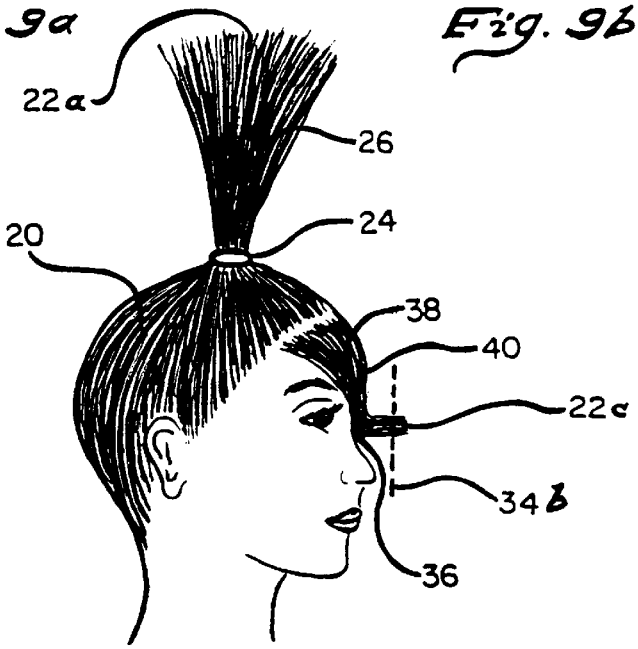
Figure 9D:
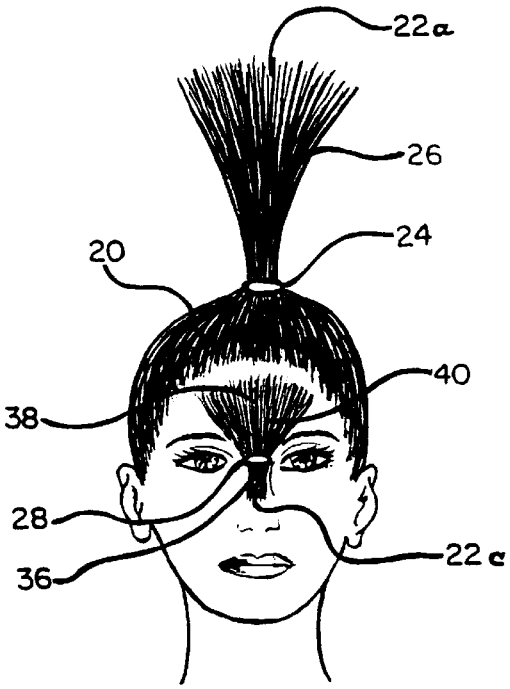
Figure 9E:
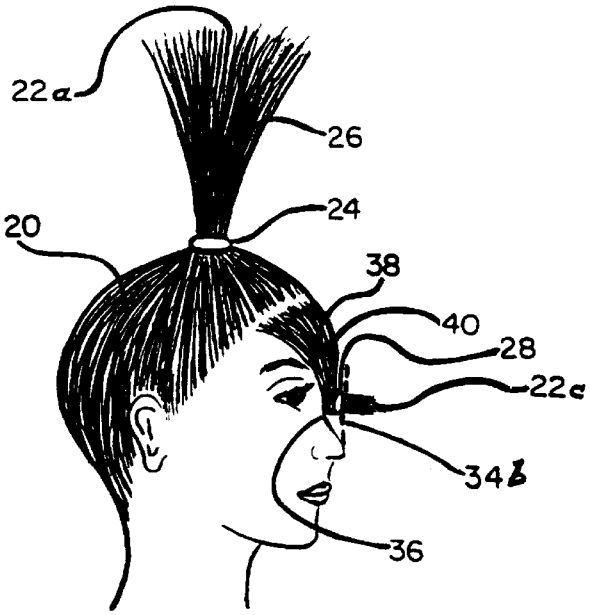

FIG. 1*e* illustrates a front view of preferred area 30*c,* located near the edge of top of forehead 38, arched in, with lines indicating small to larger amounts of bangs 40. FIG. 9*a* illustrates a front view of head with band #1 24 wrapped around hair 20 at scalp, within preferred area 30*a,* with bangs 40 sectioned out within preferred area 30*c*. FIG. 9*b* illustrates a same view as FIG. 9*a,* with ends 22*c* of bangs 40 gathered together at, and aligned with bridge of nose 36. FIG. 9*c* illustrates a side view of FIG. 9*b,* with bangs 40 firmly against forehead 38, and ends 22*c* of bangs 40 uniformly flipped out, straight, at bridge of nose 36. A vertical cutting line 34*b* is shown in broken lines, just before ends 22*c* of bangs 40. FIGS. 9*d* and 9*e* illustrate a same view as FIGS. 9*b* and 9*c* with band #2 28 added, wrapped around the gathered bangs 40, at the bridge of the nose 36, with a length of the ends 22*c* protruding. FIG. 9*e* shows a vertical cutting line 34*b* added, shown in broken lines, directly on the outer side of band #2 28, that is even, and level to band #2 28.

Figure 1F:
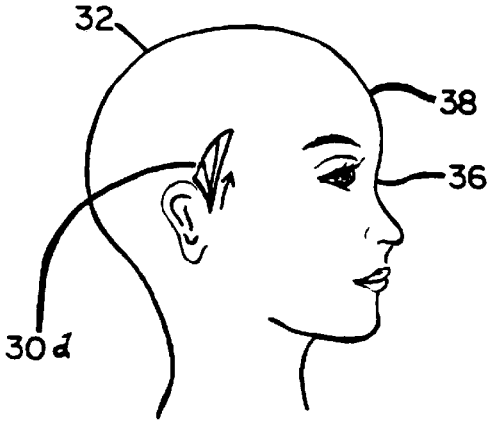
Figure 1G:
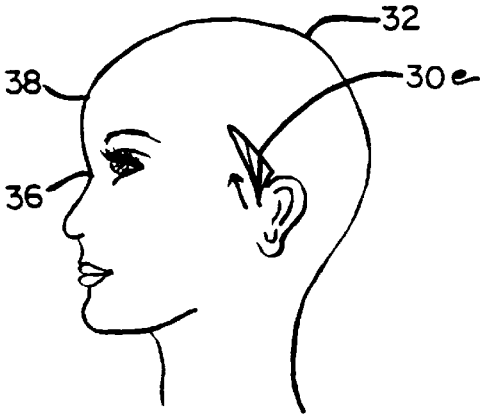
Figure 10A:
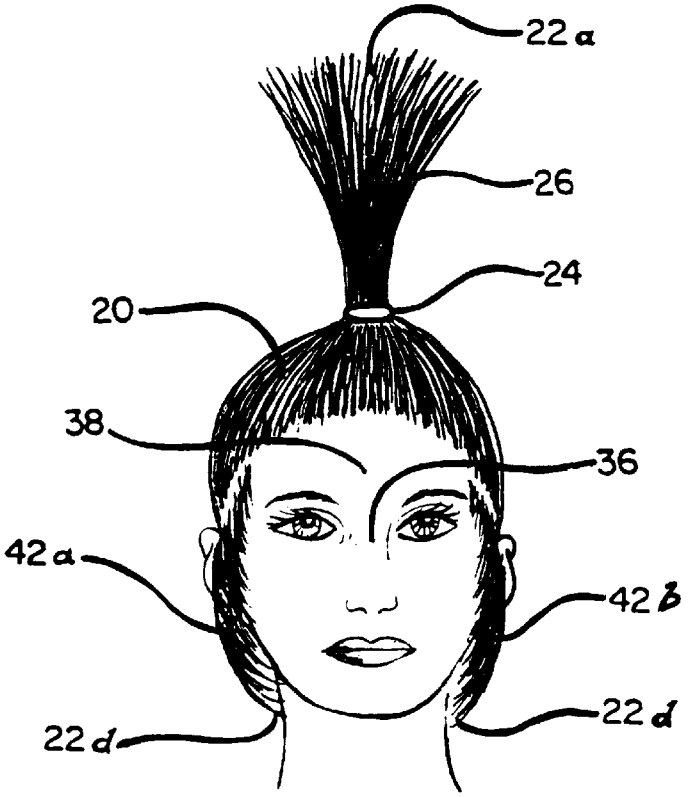
Figure 10B:
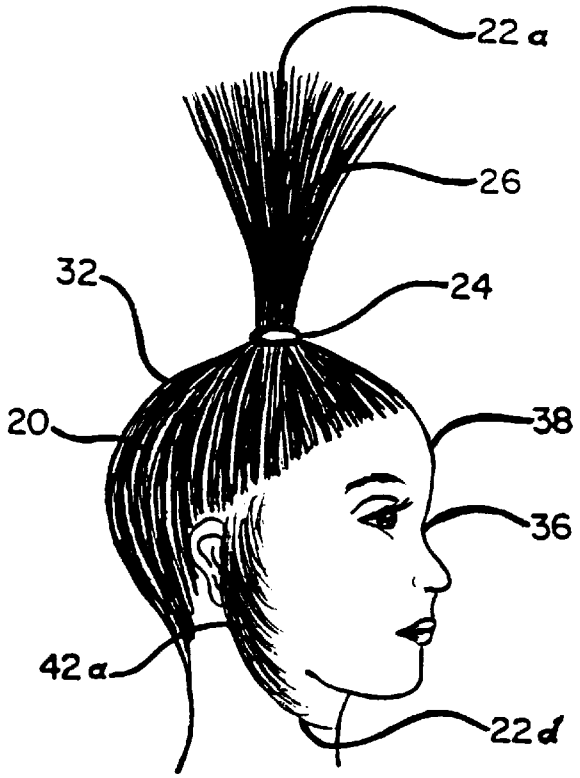
Figure 10C:
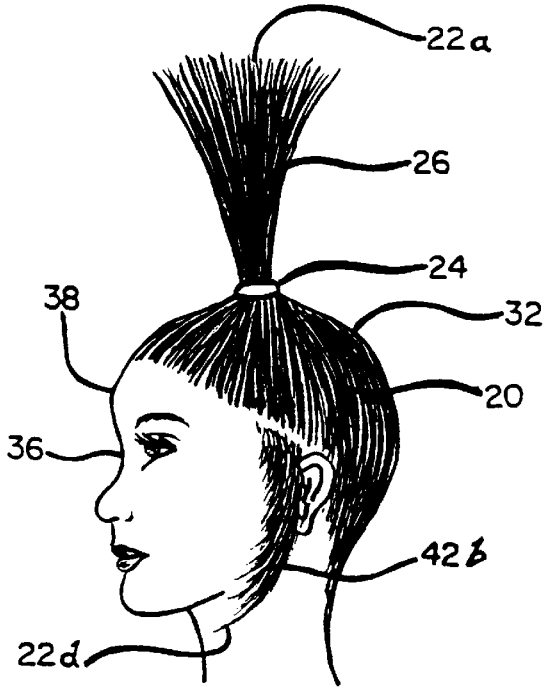
Figure 10D:
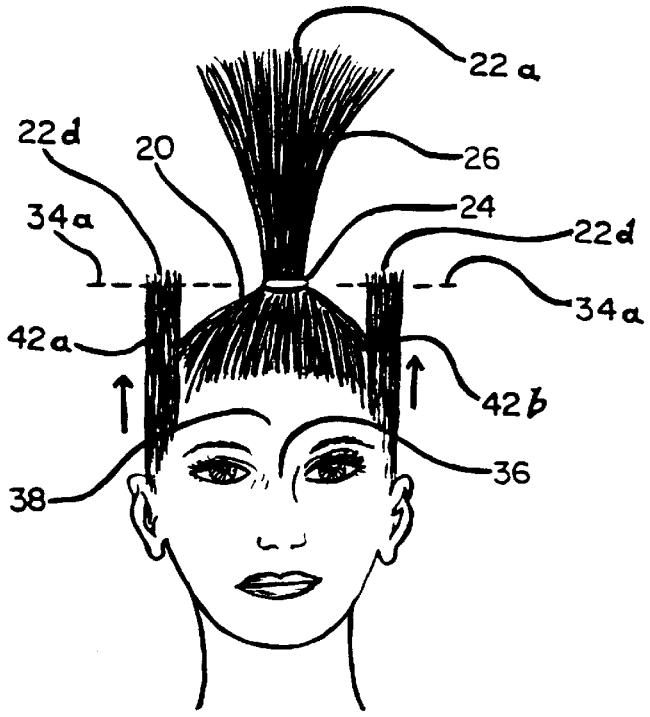
Figure 10E:
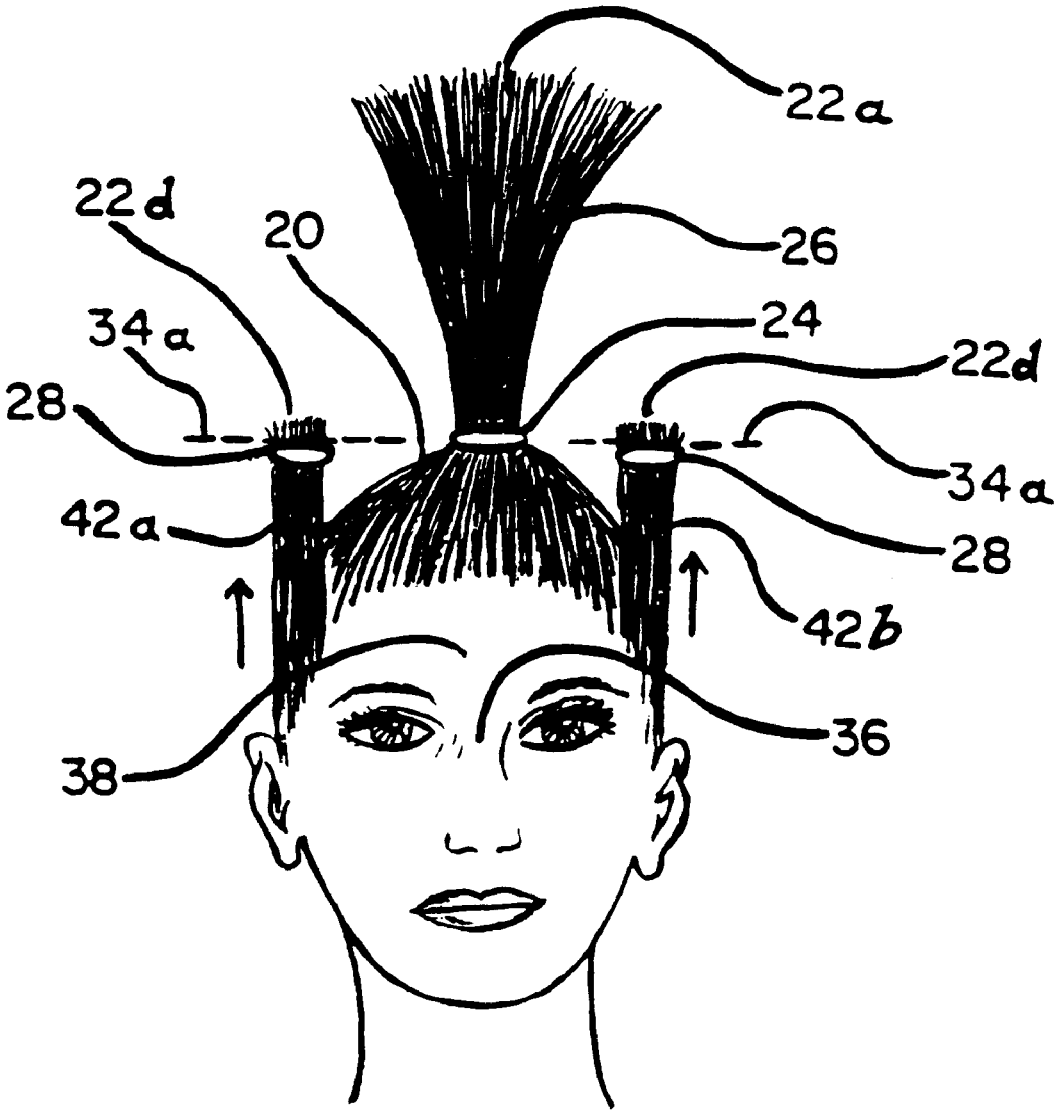

FIGS. 1*f* and 1*g* illustrate right and left side views of preferred areas 30*d* and 30*e,* located in front to above each ear, etched in, with lines indicating small to larger amounts of sidekicks 42*a* and 42*b*. FIG. 10*a* illustrates a front view of head with band #1 24 wrapped around hair 20 at scalp, within preferred area 30*a,* with sidekicks 42*a* and 42*b* sectioned out, evenly, on each side of head, within preferred areas 30*d* and 30*e*. FIGS. 10*b* and 10*c* are right and left side views of FIG. 10*a,* illustrating a further view of sidekicks 42*a* and 42*b* within preferred areas 30*d* and 30*e*. FIG. 10*d* illustrates a front view with sidekicks 42*a* and 42*b* pulled directly up, and straight. A horizontal cutting line 34*a* is shown in broken lines, just before ends 22*d* of sidekicks 42*a* and 42*b*. FIG. 10*e* illustrates a same view as FIG. 10*d* with band #2 28 added, wrapped around the gathered sidekicks 42*a* and 42*b,* near the ends 22*d,* with the ends 22*d* protruding. A horizontal cutting line 34*a* is shown in broken lines, directly on the outer side of band #2 28, that is even, and level to band #2 28.

Figure 1H:
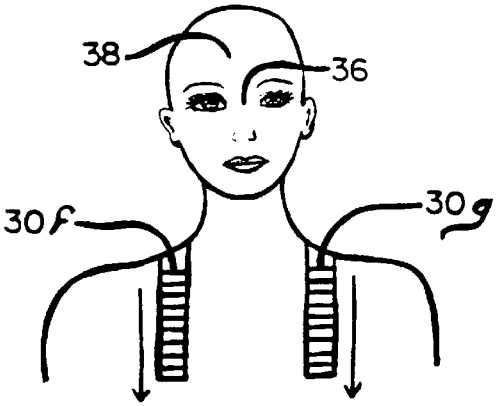
Figure 11A:
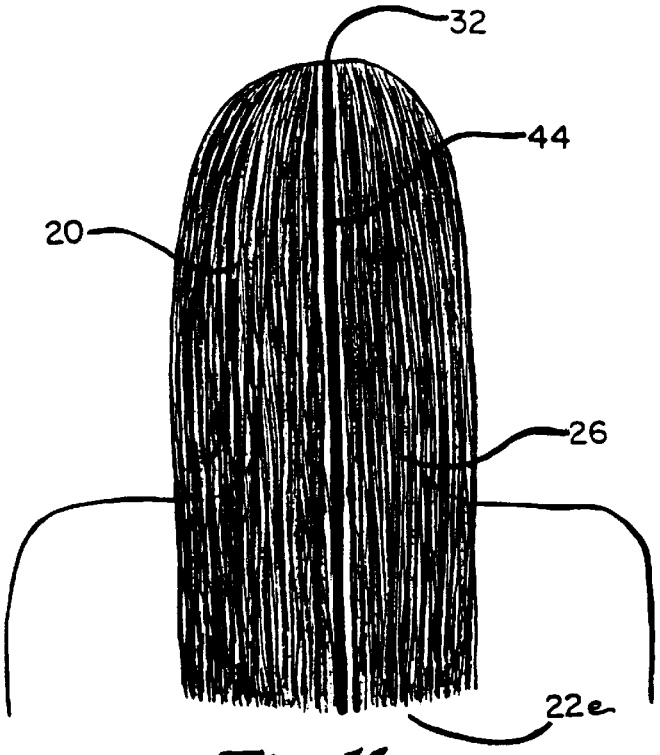
Figure 11B:
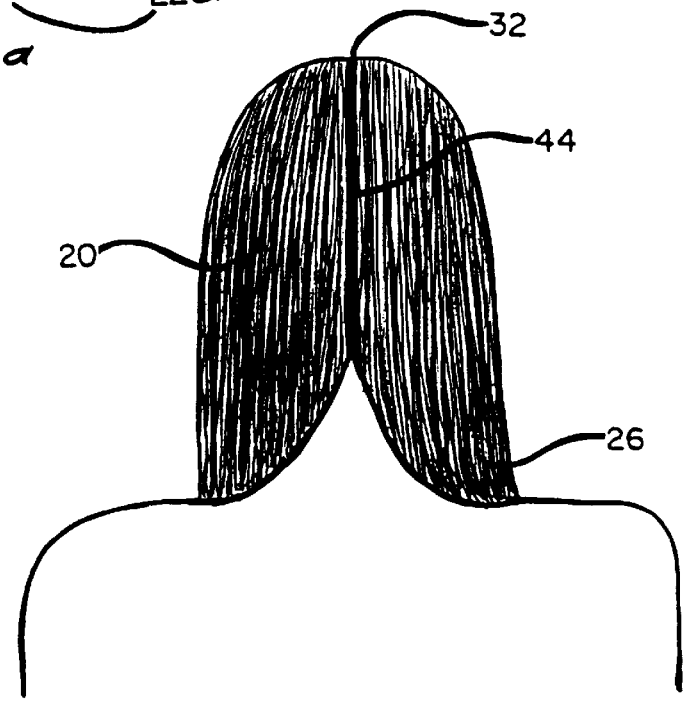
Figure 11C:
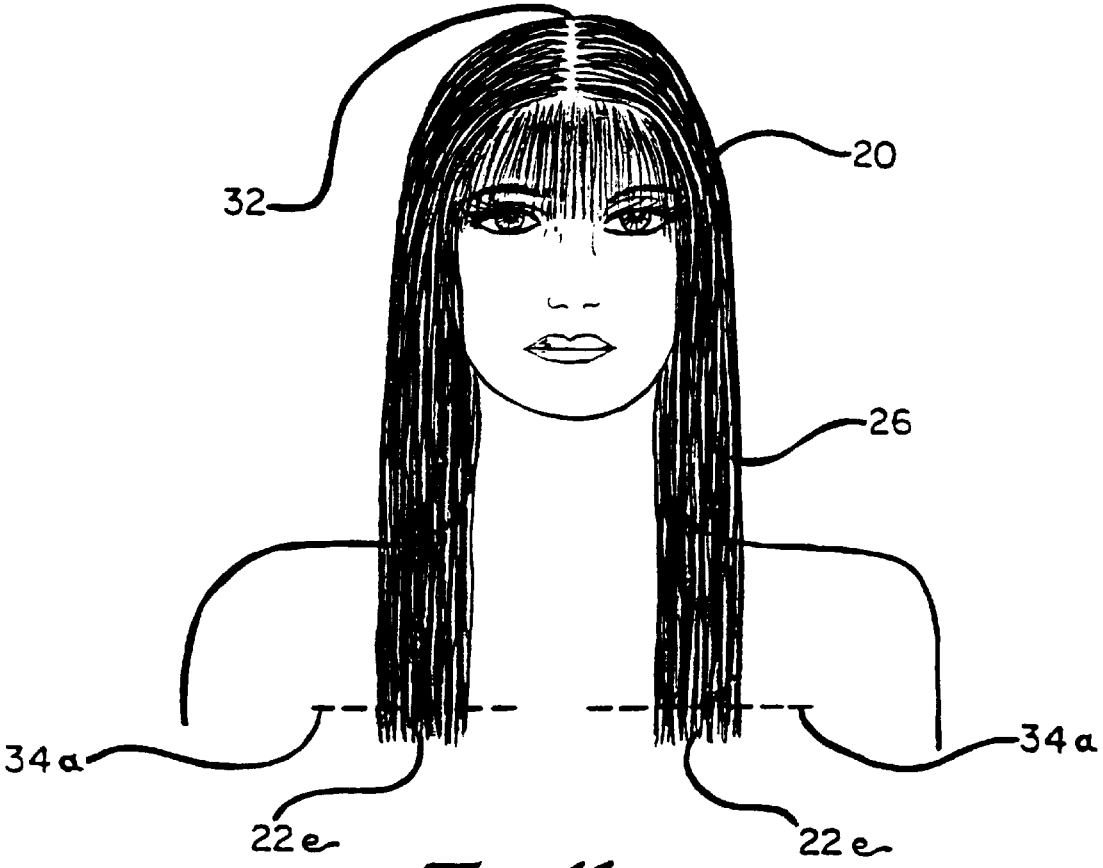
Figure 11D:
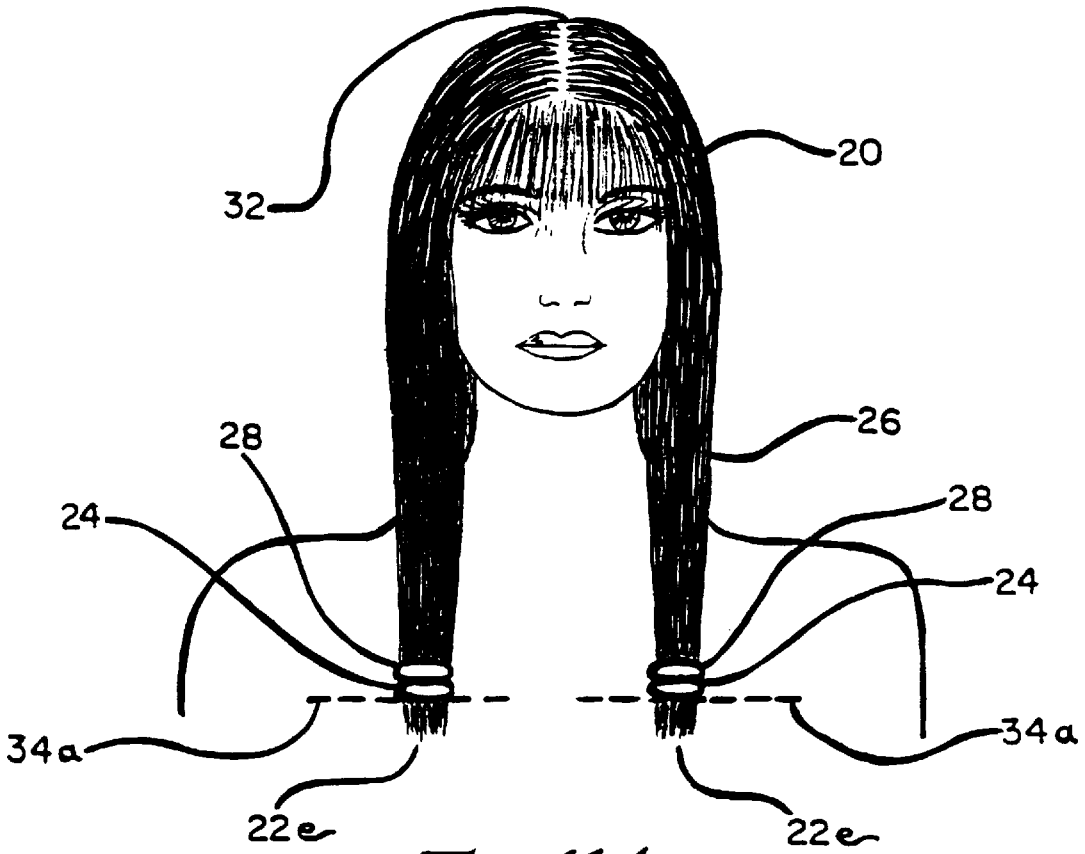

FIG. 1*h* illustrates a front view of preferred areas 30*f* and 30*g,* located on each shoulder and straight down, boxed in, with lines indicating short to longer lengths. FIG. 11*a* illustrates a back view of a head of hair 20 with uppermost body, showing a parting line 44 in the middle, starting at crown of head 32, straight down, to ends 22*e*. FIG. 11*b* illustrates a same view as FIG. 11*a* with hair 20 parted, sectioned into two, with each section brought to the front, and laid one on each shoulder. FIG. 11*c* illustrates a front view of head with uppermost body, hair 20 is sectioned uniformly into two sections, and laid one on each shoulder. A horizontal cutting line 34*a* is shown in broken lines, just before each section of ends 22*e*. FIG. 11*d* illustrates a same view as 11*c* with bands #1 24 and #2 28 added, wrapped around each gathered section, near the ends 22*e,* with the ends 22*e* protruding. A horizontal cutting line 34*a* is shown in broken lines, directly on the outer side of band #2 28, that is even, and level to band #2 28.

Operations

FIGS. 1 to 11

The manner of using the haircutting method is preferred on clean, dry hair, in front of a mirror, and in sequences as follows (hands and cutting instrument are not shown in drawings to illustrate unobstructed views):

FIGS. 1*a,* 1*b,* 2*a,* 2*b,* 3, 4*a,* 4*b,* 5*a,* and 5*b* are preferred in sequence with method on short to long layered cuts. FIG. 1*a* and 1*b* illustrate short to long layered cuts preferred area 30*a*. As in FIG. 2*a,* an individual stands, bent over at waist, so that head is upside down. While in this position, until otherwise indicated, hair 20 is combed or brushed downward (not shown) to bring ends 22*a* uniformly flowing downward. Next, head is slightly shaken (not shown) to let hair 20 settle, hair 20 is then carefully gathered (not shown) at scalp, within preferred area 30*a*. Band #1 24 is then wrapped (not shown) around hair 20 firmly, at scalp, within preferred area 30*a,* aligned with bridge of nose 36, leaving a length of hair 26 protruding, as in FIG. 2*b*.

Next, individual stands upright, facing mirror (not shown), and adds (not shown) band #2 28 on, directly next to band #1 24, as in FIG. 3*a*. At this point, individual has a multitude of options, such as, lengths, and styles, of layered cuts, the length of hair 26 can be cut at this point for the shortest cut, as shown in FIG. 3*b,* or individual can choose differentiating lengths and styles by sliding one or more bands, first band #2 28, second band #1 24, along length of hair 26 towards ends 22*a*. Length of hair 26 is kept up, straight, in direct alignment with preferred area 30*a,* and bridge of nose 36 at all times after first band, band #2 28, is slid towards ends 22*a,* using fingers, preferrably index and forefinger, of one hand, holding (not shown) first band, band #2 28, slid. By sliding band #2 28 alone to desired length of haircut, as in FIGS. 4*a* and 4*b,* resulting cuts will be a stacked style of layers. By sliding band #1 24 up, towards band #2 28, resulting cuts will be a softer style of layers, the softest being, slid directly up to and next to band #2 28, as in FIGS. 5*a* and 5*b*. For an even softer cut and style, one band, band #1 24, can be used alone (not shown). For even stackier cuts and styles, a multitude of bands 46 can be used as shown in FIGS. 3*c* and 3*d*.

After individual chooses desired length, and style, by sliding one or more bands, first band #2 28, second band #1 24, then, using other hand, ends 22*a* are cut (not shown) on the outer side of first band slid, band #2 28, towards ends 22*a* , or the last band added of the multitude of bands 46, horizontally even, level, and uniform, down to, the outer side of band, band #2 28 or the last band added of the multitude of the bands 46, using cutting line 34*a* as in FIGS. 3*b*, 3*c*, 3*d*, 4*a,* 4*b,* 5*a,* and 5*b* as an example, preferrably with scissors (not shown).

FIGS. 1*c,* 1*d,* 2*a,* 2*c,* 2*d,* 6*a,* 6*b,* 7, and 8 are preferred in sequence with method on longer feathered layered cuts. FIGS. 1*c* and 1*d* illustrates longer feathered layered cuts preferred area 30*b*. As in FIG. 2*a,* individual stands, bent over at waist, so that head is upside down. While in this position, hair 20 is combed or brushed downward (not shown) to bring ends 22*a* uniformly flowing downward. Next, individual lifts upper body (not shown) midway, as in FIG. 2*c,* slightly shakes head (not shown) to let hair 20 settle, and carefully gathers (not shown) hair 20 at forehead 38, inbetween eyebrows, within preferred area 30*b*. Band #1 24 is then wrapped (not shown) around hair 20 firmly, at forehead 38, inbetween eyebrows, within preferred area 30*b,* aligned with bridge of nose 36, leaving a length of hair 26 protruding, as in FIG. 2*d*.

Next, individual stands upright, as in FIG. 6*a,* facing mirror (not shown), and adds (not shown) band #2 28 on, directly next to band #1 24, as in FIG. 6*b*. At this point, individual has a multitude of options, such as, lengths, and styles, of layered cuts, or the last band added of the multitude of the bands 46, by sliding one or more bands, first band #2 28, second band #1 24, along length of hair 26 towards ends 22*b*. Length of hair 26 is kept out, straight, in direct alignment with preferred area 30*b,* and bridge of nose 36 at all times after first band, band #2 28, is slid towards ends 22*b,* using fingers, preferrably index and forefinger, of one hand, holding (not shown) first band, band #2 28, slid. By sliding band #2 28 alone to desired length of haircut, as in FIG. 7, resulting cuts will be a stacked style of layers. By sliding band #1 24 towards band #2 28, resulting cuts will be a softer style of layers, the softest being, slid directly up to and next to band #2 28, as in FIG. 8. For an even softer cut and style, one band, band #1 24, can be used alone (not shown). For even stackier cuts and styles, a multitude of bands 46 can be used as shown in FIG. 6*d*.

After individual chooses desired length, and style, by sliding one or more bands, first band #2 28, second band #1 24, then, using other hand, ends 22*b* are cut (not shown) on the outer side of first band slid, band #2 28, towards ends 22*b,* or the last band added of the multitude of bands 46, vertically even, level, and uniform, up to, the outer side of band, band #2 28, or the last band added of the multitude of bands 46, using cutting line 34*b* as in FIGS. 6*c*, 6*d*, 7 and 8 as an example, preferrably with scissors (not shown).

FIGS. 1*a,* 1*b,* 2*a,* 2*b,* 1*e,* 9*a,* 9*b,* and 9*c* are preferred in sequence with method on bangs 40. FIGS. 1*a* and 1*b* illustrate preferred area 30*a*. As in FIG. 2*a,* individual stands, bent over at waist, so that head is upside down. While in this position, hair 20 is combed or brushed downward (not shown) to bring ends 22*a* uniformly flowing downward. Next, hair 20 is gathered (not shown) at scalp, within preferred area 30*a*. Band #1 24 is then wrapped (not shown) around hair 20 firmly, at scalp, within preferred area 30*a,* leaving length of hair 26 protruding, as in FIG. 2*b*.

FIG. 1*e* illustrates bangs 40 preferred area 30*c*. Next, individual stands upright, facing mirror (not shown), and carefully sections (not shown) out desired amount of bangs 40 evenly, as in FIG. 9*a*. Next, ends 22*c* of bangs 40 are gathered (not shown), at bridge of nose 36, as in FIG. 9*b,* with fingers (not shown). Then, with one hand, using thumb underneath and index finger on top (not shown), bangs 40 are kept firmly against forehead 38, straight, down, and tense, by gathered ends 22*c,* at bridge of nose 36 at all times, or band, band #2 28, can be used if so desired as shown in FIGS. 9*d* and 9*e*. Next, thumb is slid slightly down and out, while rotating index finger slightly up at the same time (not shown), or the band, band #2 28, is held by the thumb and index finger and rotated in the same manner (not shown), flipping gathered ends 22*c* of bangs 40 directly out, and straight, at bridge of nose 36, as in FIGS. 9*c* and 9*e*. Then, using other hand, ends 22*c* are cut (not shown) at desired length, or directly up to the outer side of band #2 28, vertically even, level, and uniform, using cutting line 34*b* as in FIG. 9*c* as an example, preferrably with scissors (not shown). Further variations (not shown) are also possible, such as, flipping ends 22*c* of bangs 40 out on forehead 38, or holding ends 22*c* of bangs 40 straight out, in direct alignment with preferred area 30*b,* etc . . . , before cutting.

FIGS. 1*a,* 1*b,* 2*a,* 2*b,* 1*f,* 1*g,* 10*a,* 10*b,* 10*c,* and 10*d* are preferred in sequence with method on sidekicks 42*a* and 42*b*. FIGS. 1*a* and 1*b* illustrate preferred area 30*a*. As in FIG. 2*a,* individual stands, bent over at waist, so that head is upside down. While in this position, hair 20 is combed or brushed downward (not shown) to bring ends 22*a* uniformly flowing downward. Next, hair 20 is gathered (not shown) at scalp, within preferred area 30*a*. Band #1 24 is then wrapped (not shown) around hair 20 firmly, at scalp, within preferred area 30*a,* leaving length of hair 26 protruding, as in FIG. 2*b*.

FIGS. 1*f* and 1*g* illustrate sidekicks 42*a* and 42*b* preferred areas 30*d* and 30*e*. Next, individual stands upright, facing mirror (not shown), and carefully sections (not shown) out desired amount of sidekicks 42*a* and 42*b* evenly, on each side of head, as in FIGS. 10*a,* 10*b,* and 10*c*. One section of sidekick 42*a* is then pulled straight up (not shown) above head, and combed or brushed upward (not shown), to bring ends 22*d* uniformly up. Then, using one hand, sidekick 42*a* is held (not shown) up, straight, tense, and firmly inbetween straightened index and forefinger (not shown) at desired length of cut at all times, a band, band #2 28, can be used if so desired as shown in FIG. 10*e*. Next, using other hand, ends 22*d* are cut (not shown) above fingers (not shown), or on the outer side of band #2 28, horizontally even, level, and uniform, down to fingers (not shown), or band #2 28, using cutting line 34*a* as in FIGS. 10*d* and 10*e* as an example, preferrably with scissors (not shown). Method is then repeated with other sidekick 42*b*. Sidekicks 42*a* and 42*b* are then both held up, straight, one with each hand (not shown), compared lengths, and matched. Further variations (not shown) are also possible, such as, holding ends 22*d* of sidekicks 42*a* and 42*b* up slightly forward or back, or ends 22*d* of sidekicks 42*a* and 42*b* can be gathered, together, at forehead 38, within preferred area 30*b,* etc . . . , before cutting.

FIGS. 1*h,* 11*a,* 11*b,* and 11*c* are preferred in sequence with method on all one length of hair 26, or ends 22*e*. FIG. 1*h* illustrates preferred areas 30*f* and 30*g*. While standing in an upright position, facing mirror (not shown), hair 20 is combed or brushed straight, downward (not shown) to bring ends 22*e* uniformly downward. Hair 20 is then parted into two sections, using parting line 44 in FIG. 11*a* as an example, from the back of head, starting at crown of head 32, straight, down to nape of neck. Each section is then brought forward (not shown) and laid one on each shoulder, as in FIGS. 11*b* and 11*c*. Next, starting with one section, hair 20 is combed or brushed again (not shown), straight, down, to insure ends 22*e* are flowing downward uniformly. Then with one hand, ends 22*e* are held (not shown) down, straight, tense, and firmly inbetween straightened index and forefinger (not shown) at desired length of cut at all times, or bands, band #1 24 and #2 28, can be used if so desired as shown in FIG. 11*d*. Next, using other hand, ends 22*e* are cut (not shown) underneath fingers (not shown), or on the outer side of band #2 28, horizontally even, level, and uniform, up to fingers (not shown), or band #2 28, using cutting line 34*a* as in FIGS. 11*c* and 11*d* as an example, preferrably with scissors (not shown). Method is then repeated with other section. Sections are then both held down, straight, one with each hand (not shown), compared lengths, and matched. By cutting ends 22*e* held (not shown) as close to body as possible, results will be a straighter cut and style. By cutting ends 22*e* held (not shown) slightly away or further from body, results will be a stackier cut and style. Further variations (not shown) are also possible, such as, holding ends 22*e* slightly in towards neck, or out towards ends of shoulders, etc . . . , before cutting.

Summary, Ramifications, and Scope

Thus the reader will see that the haircutting method of this invention is economical, versatile, reliable, precise, efficient, convenient, easy, fun, and so simple, even a child of reasonable age can cut their own hair, supervised. That it can be done in minutes, easily maintained, or repeated for a lifetime, with a choice of a multitude of stylish, professional looking haircuts, providing superior options in home and self haircutting, without the need of bothersome devices, and with a minimum of risk, error, and cost.

While my above description contains many specifications, these should not be construed as limitations on the scope or spirit of the invention, but rather as exemplifications of one or more preferred embodiments thereof. Many variations are possible. For example:

* can be used by an individual on another
* can be used with any band, size, or number of bands
* can be used with most any haircutting instrument
* can be used outside of preferred areas
* haircuts and styles can be combined
* bent over body positions can differ

* sectioned amounts of hair can be used in preferred areas

Accordingly, the scope and spirit of the invention should be determined not by the embodiments and examples illustrated, but by the appended claims and their legal equivalents.

I claim:

1. A method of cutting a person's hair comprising the steps of:

a.) combing or brushing at least a portion of hair in a downward, upward or outward fashion;

b.) gathering the at least a portion of hair together so as to leave a length of hair extending beyond the gathered hair;

c.) wrapping a first band about the gathered hair such that the length of hair extends beyond the first band;

d.) wrapping at least one additional band about the gathered hair such that an inside edge thereof is directly adjacent the first band with the length of hair extending beyond an outside edge of the at least one additional band;

e.) sliding the at least one additional band along the length of hair, away from the first band so as to produce a desired final length; and f.) cutting the hair extending beyond the at least one additional band along the outside edge of the at least one additional band.

2. The Hair cutting method of claim 1, wherein prior to the step of combing or brushing the hair, the person bends over at the waist with their head upside-down or facing downward and brushes the hair in a downward fashion; and prior to the step of gathering the hair together, the person gently shakes their head so as to let the hair settle; and after the step of wrapping the first band about the gathered hair and prior to the step of wrapping the at least one additional band, the person stands upright so as to produce a refined layered cut.

3. The hair cutting method of claim 1, wherein the hair is gathered at the scalp or at the forehead between the eyebrows.

4. The hair cutting method of claim 1, wherein prior to the step of cutting the hair, the first band is slid along the length of hair toward the at least one additional band so as to produce a softer cut.

5. The hair cutting method of claim 1, wherein there are a multitude of additional bands which are wrapped about the gathered hair such that each additional band is directly adjacent another band with the length of hair extending beyond the outside edge of the last band so as to produce a longer desired final length and a stackier cut.

6. The hair cutting method of claim 1, wherein prior to the step of wrapping the at least one additional band, the gathered hair is sectioned-out at the edge of the person's forehead so as to produce bangs and the at least one additional band is wrapped about the thus sectioned-out hair; and prior to the step of cutting the hair, the sectioned-out hair is held against the person's forehead and the at least one additional band is rotated outward, flipping the length of hair extending beyond the at least one additional band straight out, away from the person's face so as to produce a soft, slightly arched cut.

7. The hair cutting method of claim 1, wherein the bands are teri-cloth, endless-loop, elastic hairbands.

8. A method of cutting a person's own hair comprising the steps of:

a.) combing or brushing at least a portion of hair in a downward, upward or outward fashion;

b.) gathering the at least a portion of hair together so as to leave a length of hair extending beyond the gathered hair;

c.) wrapping a first band about the gathered hair such that the length of hair extends beyond the first band;

d.) standing in front of a mirror e.) wrapping at least one additional band about the gathered hair such that an inside edge thereof is directly adjacent the first band with the length of hair extending beyond an outside edge of the at least one additional band;

f.) sliding the at least one additional band along the length of hair, away from the first band so as to produce a desired final length; and g.) cutting the hair extending beyond the at least one additional band along the outside edge of the at least one additional band.

9. The Hair cutting method of claim 8, wherein prior to the step of combing or brushing the hair, the person bends over at the waist with their head upside-down or facing downward and brushes the hair in a downward fashion; and prior to the step of gathering the hair together, the person gently shakes their head so as to let the hair settle; and after the step of wrapping the first band about the gathered hair and prior so the step of wrapping the at least one additional band, the person stands upright so as to produce a refined layered cut.

10. The hair cutting method of claim 8, wherein the hair is gathered at the scalp or at the forehead between the eyebrows.

11. The hair cutting method of claim 8, wherein prior to the step of cutting the hair, the first band is slid along the length of hair toward the at least one additional band so as to produce a softer cut.

12. The hair cutting method of claim 8, wherein there are a multitude of additional bands which are wrapped about the gathered hair such that each additional band is directly adjacent another band with the length of hair extending beyond the outside edge of the last band so as to produce a longer desired final length and a stackier cut.

13. The hair cutting method of claim 8, wherein prior to the step of wrapping the at least one additional band, the gathered hair is sectioned-out at the edge of the person's forehead so as to produce bangs and the at least one additional band is wrapped about the thus sectioned-out hair; and prior to the step of cutting the hair, the sectioned-out hair is held against the person's forehead and the at least one additional band is rotated outward, flipping the length of hair extending beyond the at least one additional band straight out, away from the person's face so as to produce a soft, slightly arched cut.

14. The hair cutting method of claim 8, wherein the bands are teri-cloth, endless-loop, elastic hairbands.

* * * * *

UNITED STATES PATENT AND TRADEMARK OFFICE

CERTIFICATE OF CORRECTION

PATENT NO. : 5,927,292

DATED : July 27, 1999

INVENTOR(S) : Annette M.R. Chicoine

It is certified that error appears in the above-identified patent and that said Letters Patent is hereby corrected as shown below:

Col.4, line 39, change "vertically" to --vertical--.

Col.6, line 52, change "or the last band added of the multitude of the bands 46" to --the length of hair 26 can be cut at this point for the shortest cut, as shown in FIG. 6c, or individual can choose differentiating lengths and styles--.

Col.7, line 39, change "FIG. 9c" to --FIGS. 9c and 9e--.

UNITED STATES PATENT AND TRADEMARK OFFICE

CERTIFICATE OF CORRECTION

PATENT NO. : 5,927,292

DATED : July 27, 1999

INVENTOR(S) : Annette M.R. Chicoine

It is certified that error appears in the above-identified patent and that said Letters Patent is hereby corrected as shown below:

Col.10, line 32, change "so" to --to--.

Signed and Sealed this

Twenty-fifth Day of January, 2000

*Attest:*

*Attesting Officer*

*Acting Commissioner of Patents and Trademarks*